US005426459A

United States Patent [19]

Kaplinsky

[11] Patent Number: 5,426,459

[45] Date of Patent: Jun. 20, 1995

[54] COMBINED FILTER/AIRCHECK VALVE FOR THERMAL INK-JET PEN

[75] Inventor: George T. Kaplinsky, San Diego, Calif.

[73] Assignee: Hewlett-Packard Company, Palo Alto, Calif.

[21] Appl. No.: 995,109

[22] Filed: Dec. 22, 1992

[51] Int. Cl.[6] ..... B41J 2/175; B41J 2/19

[52] U.S. Cl. ..... 347/87; 347/93

[58] Field of Search ..... 346/140 R; B41J 2/175, B41J 2/19; 347/84–87, 93

[56] References Cited

U.S. PATENT DOCUMENTS

| | | | |
|---|---|---|---|
| 4,095,237 | 6/1978 | Amberntsson et al. | 346/140 R |
| 4,149,172 | 4/1979 | Heinzl et al. | 346/140 R |
| 4,183,031 | 1/1980 | Kyser et al. | 346/140 R |
| 4,272,773 | 6/1981 | Halasz | 346/140 R |
| 4,422,084 | 12/1983 | Saito | 346/140 R |
| 4,571,599 | 2/1986 | Rezanka | 346/140 R |
| 4,673,955 | 6/1987 | Ameyama et al. | 346/140 R |
| 4,714,937 | 12/1987 | Kaplinsky | 346/140 R |
| 4,931,811 | 6/1990 | Cowger et al. | 346/140 R |
| 5,040,002 | 8/1991 | Pollacek et al. | 346/140 R |
| 5,280,300 | 1/1994 | Fong et al. | 346/140 R X |

FOREIGN PATENT DOCUMENTS

| | | |
|---|---|---|
| 0437363 | 10/1991 | European Pat. Off. . |
| 0041777 | 11/1981 | Japan . |
| 58-112748 | 7/1983 | Japan . |
| 2-001324 | 1/1990 | Japan . |

*Primary Examiner*—Joseh W. Hartary
*Assistant Examiner*—Alrick Bobb

[57] ABSTRACT

A thermal ink-jet pen cartridge including an ink reservoir for maintaining ink under negative pressure. The ink reservoir is coupled to the printhead via a discharge port. To prevent air bubbles from entering the reservoir via the discharge port and printhead after ink is expelled via the thermal process, a check valve is placed in the fluid path between the ink reservoir and the printhead at the discharge port. The check valve is a mesh having a very small mesh opening sufficient to prevent air bubbles from passing through under normal pressures. The check valve also serves the function of a particulate filter to prevent contamination of the printhead by particles from the ink reservoir.

10 Claims, 3 Drawing Sheets

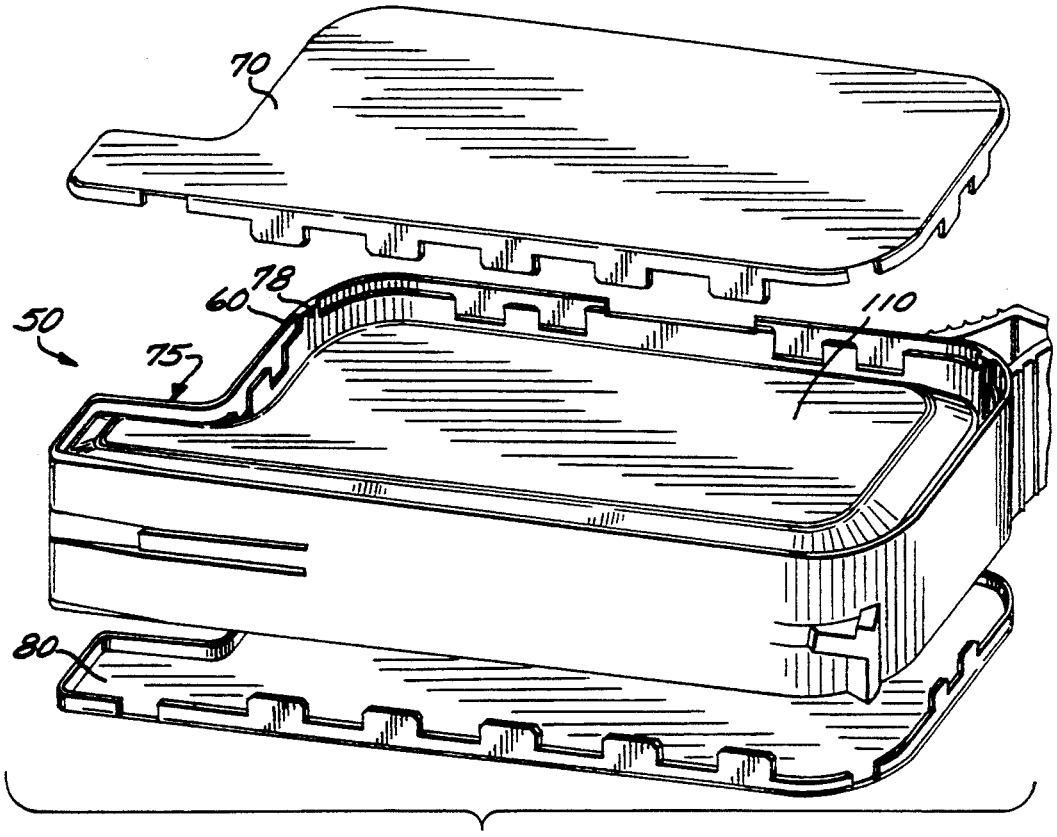
FIG. 1
FIG. 2
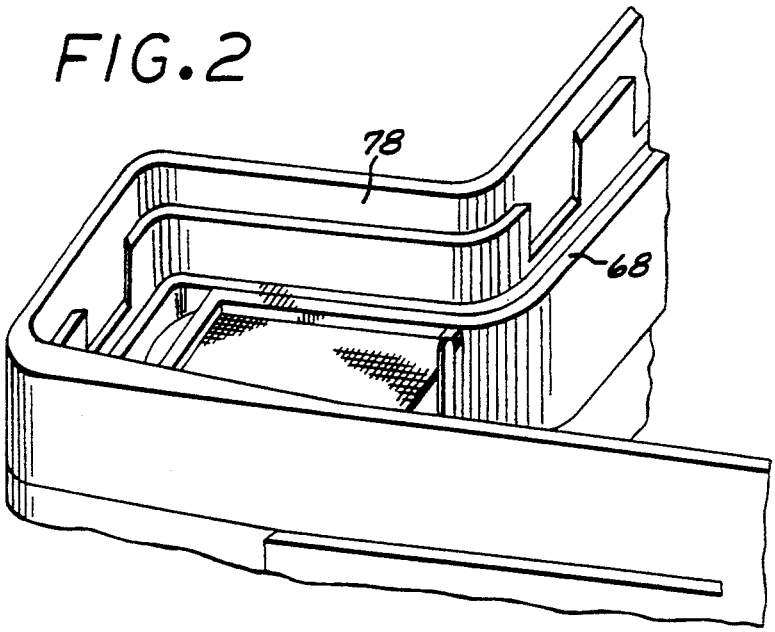

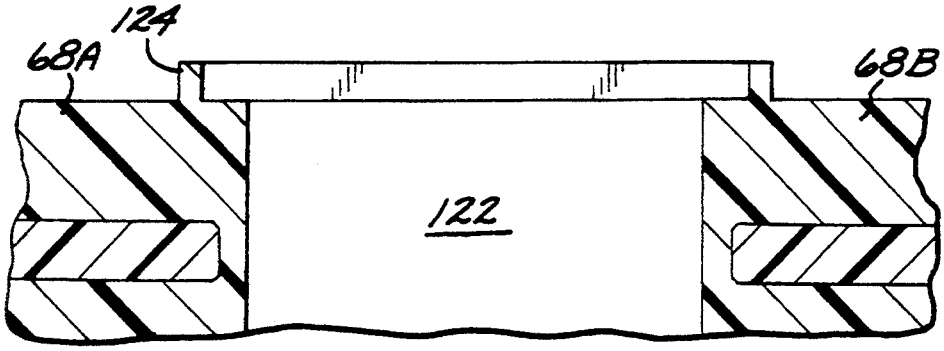
FIG. 6
FIG. 7
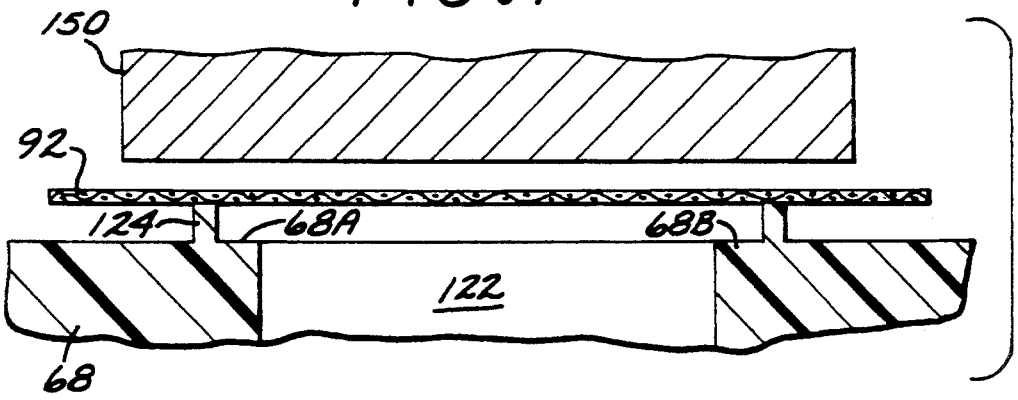
FIG. 8
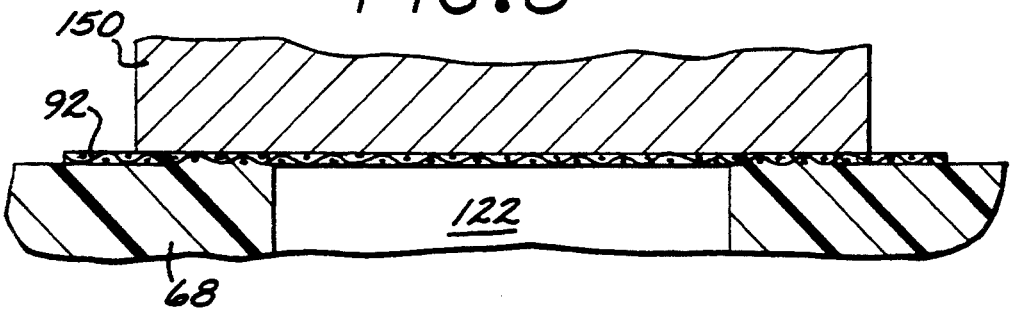
FIG. 9
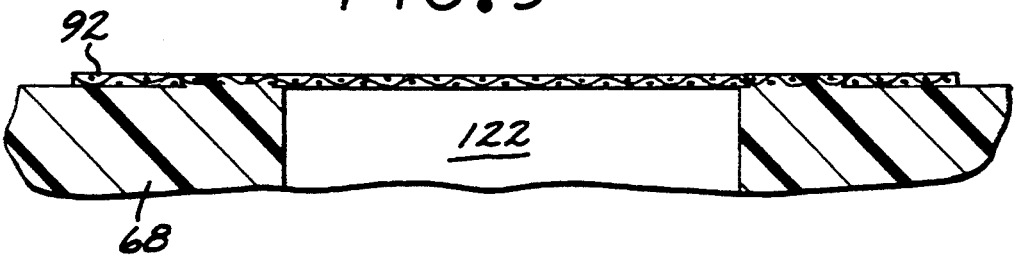

COMBINED FILTER/AIRCHECK VALVE FOR THERMAL INK-JET PEN

The present invention is related to the following pending U.S. patent applications: COMPACT FLUID COUPLER FOR THERMAL INK JET PRINT CARTRIDGE INK RESERVOIR, Ser. No. 07/853,372, filed Mar. 18, 1992, by James G. Salter et al.; INK PRESSURE REGULATOR FOR A THERMAL INK-JET PRINTER, Ser. No. 07/928,811, filed Aug. 12, 1992, by Tofigh Khodapanah et al.; COLLAPSIBLE INK RESERVOIR STRUCTURE AND PRINTER INK CARTRIDGE, Ser. No. 07/929,615, filed Aug. 12, 1992, by George T. Kaplinsky et al.; TWO MATERIAL FRAME HAVING DISSIMILAR PROPERTIES FOR A THERMAL INK-JET CARTRIDGE, by David S. Swanson et al., Ser. No. 07/994,807, filed Dec. 22, 1992; RIGID LOOP CASE STRUCTURE FOR THERMAL INK-JET PEN, by David W. Swanson et al., Ser. No. 07/994,808, filed Dec. 22, 1992; DOUBLE COMPARTMENT INK-JET CARTRIDGE WITH OPTIMUM SNOUT, by David W. Swanson et al., Ser. No. 07/995,221, filed Dec. 22, 1992; THERMAL INK-JET PEN WITH A PLASTIC/METAL ATTACHMENT FOR THE COVER, by Dale D. Timm, Jr. et al., Ser. No. 07/994,810, filed Dec. 22, 1992; THIN PEN STRUCTURE FOR THERMAL INK-JET PRINTER, by David W. Swanson et al., Ser. No. 07/994,809, filed Dec. 22, 1992; and SPRING BAG PRINTER INK CARTRIDGE WITH VOLUME INDICATOR, by David S. Hunt et al., application Ser. No. 07/717,735 filed Jun. 19, 1991; U.S. Pat. No. 5,359,353; the entire disclosures of which are incorporated herein by this reference.

BACKGROUND OF THE INVENTION

This invention relates to thermal ink-jet (TIJ) printers, and more particularly to improvements in the pens used therein.

TIJ printers typically include a TIJ pen which includes a reservoir of ink coupled to the TIJ printhead. One type of pen includes a polymer foam disposed within the print reservoir so that the capillary action of the foam will prevent ink from leaking or drooling from the printhead. In such a pen, a fine mesh filter is typically provided in the fluid path between the reservoir and the printhead to trap particles before reaching the printhead and thereby interfering with printhead operations. This foam pen includes a vented air delivery system, wherein as ink is drawn from the ink reservoir during printing operations, air enters the reservoir via a separate vent opening.

The TIJ pen 50 illustrated in FIG. 1 and described in the referenced co-pending applications affords many benefits for the printing system built to utilize it. The pen is thin which directly reduces the required width of the printer carriage and subsequently the total width of the printer. The ink delivery system is simple and efficient. Ink is contained within a reservoir formed by two pieces of thin polyethylene bag material that have been thermally bonded to a compatible plastic material on the frame 60. Two pistons and a spring inside the bag provide back-pressure to prevent ink from drooling out of the printhead, i.e., the ink is maintained under negative pressure within the reservoir. The frame 60 is made of two different plastic materials. One material is an engineering plastic forming the external surfaces and providing structural support and the second material provides the fluid path for the ink and is suitable for thermal attachment of the bag material. The thin metal sidecovers 70 and 80 protect the inside components, add considerable rigidity to the system, and allow for a high degree of volumetric efficiency (volume of deliverable ink compared to the external volume of the pen). Sidecovers made from a metal having a surface such a prepainted or PVC clad material are used to cover the springbag and other components of this TIJ pen.

Negative pressure on the ink within the reservoir will tend to draw air bubbles through the printhead and the fluid path into the reservoir when exposing the pen to shock. A problem with negative pressure pens such as that shown in FIG. 1 is the leakage of air bubbles through the printhead and into the ink reservoir, thus reducing and ultimately equalizing the pressure on the ink in the reservoir. As the negative pressure is reduced or eliminated, ink will readily drool from the printhead when the pen is subjected to even minor shocks during handling or operation.

It is therefore an object of this invention to provide a solution to the problem of leakage of air bubbles into an ink reservoir under negative pressure.

A further object is to provide a thermal ink-jet pen having a negative pressure ink reservoir with an air check valve disposed in the ink fluid path between the ink reservoir and the printhead.

SUMMARY OF THE INVENTION

A thermal ink-jet pen having a thermal ink-jet printhead and an ink reservoir for maintaining a supply of ink under negative pressure is described. The reservoir includes a rigid frame and a pair of flexible impervious membranes sealingly joined to the frame, and spring means for urging the membranes apart from each other to create the negative pressure.

A fluid path is provided between the reservoir and the printhead to permit ink to flow from the reservoir to the printhead.

In accordance with the invention, an air check valve disposed in the fluid path to prevent air from passing from the printhead into the reservoir via the fluid path while allowing ink flow in the opposite direction from the reservoir to the discharge port upon demand. In the preferred embodiment, the air check valve comprises a fine wire mesh having a mesh opening size which does not permit air bubbles to pass therethrough under the nominal air bubble pressure experienced by the pen in the normal usage or storage. The air check valve prevents air bubbles from passing from the printhead to the reservoir and neutralizing the negative pressure to thereby permit ink to drool out of the printhead.

The air check valve also functions as a filter for preventing particulate contamination from reaching the printhead from the ink reservoir.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is an isometric view of a thermal ink-jet pen cartridge embodying the invention, shown with its covers in an exploded form.

FIG. 2 is an enlarged view of the snout region of the pen of FIG. 1.

FIG. 6 is a cross-sectional view taken along line 6—6 of FIG. 5.

FIGS. 7–9 illustrate a technique for assembling the air check valve screen to the snout region of the pen of FIG. 1.

DETAILED DESCRIPTION OF THE PREFERRED EMBODIMENT

Figure 3:
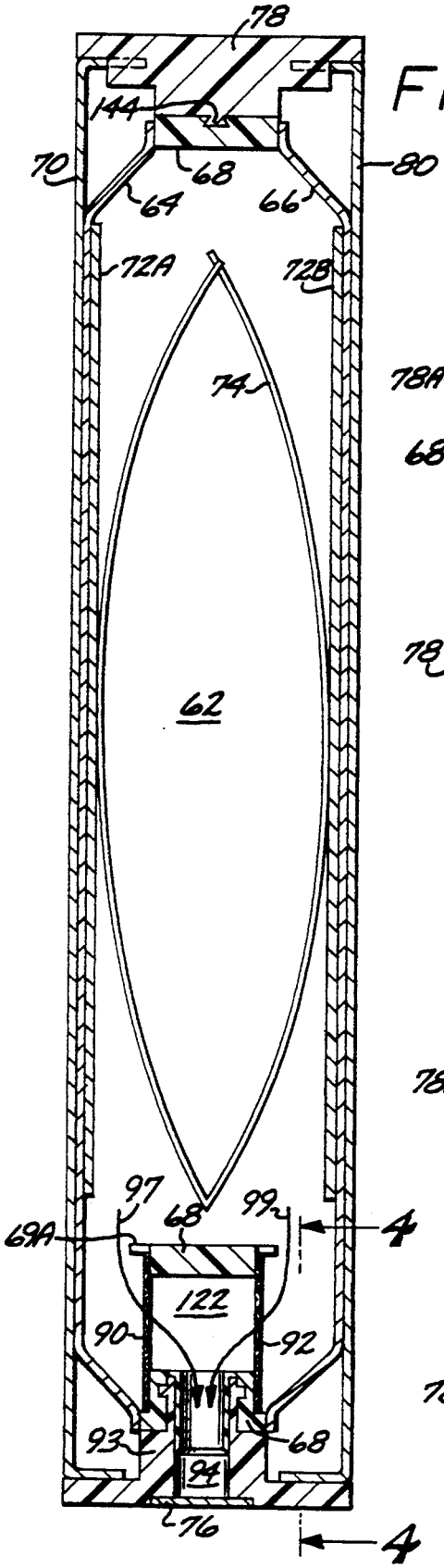
FIG. 3 is a cross-sectional view of the pen of FIG. 1, taken lengthwise through the pen snout region.

FIGS. 1–9 illustrate a thermal ink-jet pen cartridge 50 embodying the present invention. The pen 50 comprises an external frame structure 60 which defines a closed band or loop defining the periphery of the pen 50. The pen structure 60 comprises two chemically dissimilar plastic members 78 and 68. The external plastic member 78 is molded from a relatively rigid engineering plastic such as a glass-filled modified polyphenylene oxide, such as the material marketed under the trademark "NORYL" by General Electric Company. An inner plastic member 68 is injection molded to the inner periphery of the external plastic member 78, and is fabricated of a plastic material suitable for attaching the ink reservoir membranes 64 and 66. A plastic suitable for the inner plastic member 68 is a polyolefin alloy or 10 percent glass-filled polyethylene.

The frame 60 defines a generally rectilinear open volume region 110 and a snout region 75 protruding from one corner of region 110. The external plastic member 78 is molded to form a standpipe 93 with an interior opening or channel 94 formed therein. The standpipe channel 94 communicates with a TIJ printhead 76 secured across the external end of the snout opening 94. Ink flows through the standpipe channel 94 to supply the printhead 76 with ink. As drops of ink are forced outwardly through the printhead nozzles, ink flows through the standpipe 94 from the reservoir 62 via the fluid paths indicated generally by arrows 97 and 99 to replenish the ink supply available to the printhead 76.

The inner plastic member 68 further includes a support rib 120 which extends across the throat of the snout region 75, separating the snout region from the main ink reservoir area 62. A generally rectangular chamber area 122 is formed by a surrounding structure of the inner member 68 extending between the rib 120 and the inner opening of the standpipe channel 94.

First and second membranes 64 and 66 are attached to the inner plastic member 68 through heat staking, adhesives or other conventional bonding processes, to form a leakproof seal between the inner plastic member 68 and the membranes. The membranes 64 and 66 are formed of a material which is impermeable to the ink to be stored within the ink reservoir, and compatible with the plastic of material from which the inner plastic member 68 is fabricated. The ink delivery system includes a spring 74 which applies a separating force against two opposed piston plates 72A and 72B inside the ink reservoir to separate the membranes 64 and 66. The spring and piston elements maintain negative pressure on the ink in the reservoir to keep the ink from drooling from the printhead 76. As ink is consumed from the reservoir, atmospheric pressure on the membranes 64 and 66 result in compression of the spring with the plates 72A and 72B drawn toward each other.

The membranes 64 and 66 extend over the standpipe region, and in this embodiment are heat staked along the edge regions 68A, 68B and 68C (FIG. 4) to maintain the sealing of the membranes along the periphery of the snout region 75. The membranes 64 and 66 are not sealed to the region of the rib 120. Standoffs 69A and 69B comprising the inner plastic member 68 hold the membranes off the area of rib 120, to ensure the membranes do not sag against the support rib structure and thereby close off the ink flow from the ink reservoir to the standpipe 93.

In accordance with the invention, an air check valve is provided in the fluid path between the printhead 76 and the ink reservoir 62, to prevent air bubbles from travelling from the printhead into the reservoir 62. The valve also serves the function of a filter to prevent particulate contaminates from flowing from the ink reservoir 62 to the printhead 76 and clogging the printhead nozzles. In this embodiment, the valve includes two valve members 90, 92 one on each side of the frame. The valve members 90 and 92 each comprise, in this exemplary embodiment, a section of finely woven stainless steel mesh, the edges of which are attached to the inner plastic member. The mesh has a nominal passage dimension of 15 microns between adjacent mesh strands, and has a typical thickness of less than 0.006 inches, 0.15 mm. In this embodiment, each mesh member 90 and 92 is square, and covers an area of about one centimeter by one centimeter. A mesh marketed under the tradename RIGIMESH-J by Engle Tool and Die, Eugene, Oreg., is suitable for performing the function of the check valve. The mesh passage size is sufficiently small that, while ink may pass through the passages of the mesh, air bubbles under normal atmospheric pressure will not pass through the mesh passages which are wetted by the ink. The required air bubble pressure necessary to permit bubbles to pass through the mesh, in this embodiment, about 30 inches of water, is well above that experienced by the pen under any typical storage, handling or operational conditions. As a result, the mesh serves the function of an air check valve for the pen.

A second function fulfilled by the mesh valve is that of a particulate filter, preventing particles as small as 15 microns from passing through the mesh. It is known to use a mesh of this mesh opening size in a particulate filter in vented, foam-filled ink reservoirs, Such reservoirs have no need for an air check valve.

There is a pressure drop across the mesh members 90 and 92; if the mesh opening size is too small, not enough ink will flow through the mesh and the printhead 76 will starve. Two separate mesh members 90 and 92 are employed to ensure sufficient ink flow from the reservoir 92 into the chamber 94.

Figure 4:
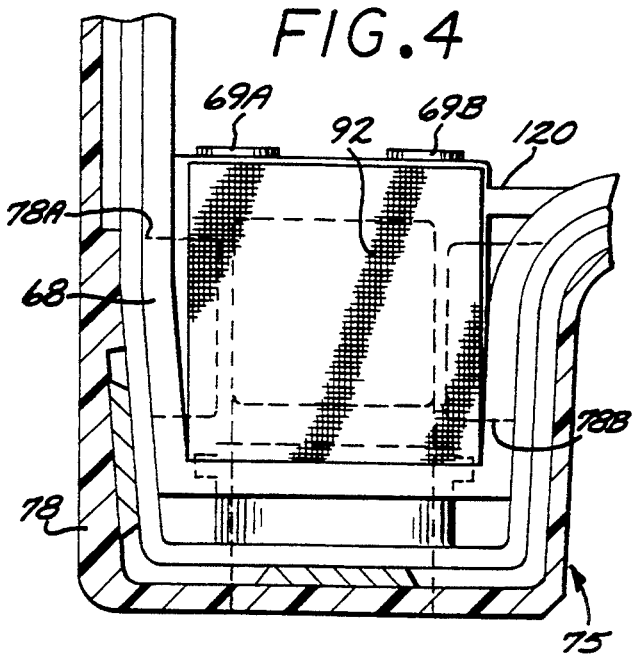
FIG. 4 is a broken away cross-sectional view of the snout region of the pen of FIG. 1.
Figure 5:
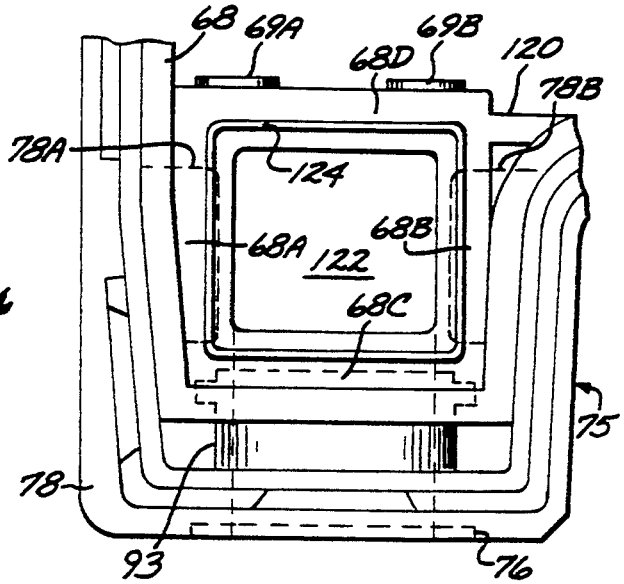
FIG. 5 is a view of the snout region of the pen of FIG. 1, taken prior to installation of the air check valve.

FIGS. 4 and 5 illustrate the snout region 75 of the pen 50, with FIG. 4 a cross-section taken along line 4—4 of FIG. 3, and FIG. 5 a view of the snout without the covers and valve element 90 and 92 in place. The frame member 78 includes a pair of inwardly facing tabs 78A and 78B which provide support to the portion of inner frame member 68 molded around the inner periphery of the snout region 75. The frame member 68 defines inner chamber 122, with a rectilinear frame portion extending around the periphery of the chamber. The frame portion is defined by side regions 68A–D. As shown in FIG. 3, the width of member 68 defines the width of the chamber 122. The side regions 68A–D thus define a window into the chamber 122 on each cover-facing side of the member 68. Each side of the chamber 122 which extends in a perpendicular sense to the plane of the covers 70 and 80 is defined by the plastic comprising member 68.

During operation, air bubbles may accumulate in the chamber 122. The printer in which the pen 50 is installed may include a priming station to apply a vacuum to the printhead to withdraw the air bubbles through the printhead, and draw ink from the reservoir to fill the standpipe opening and the chamber 122. Such priming stations are known in the art.

The frame member 68 is molded to define a thin lip 124 which protrudes from the side regions 68A–D and extends around the periphery of the frame portion. Such a lip is defined on each cover-facing side of the member 68; only lip 124 is visible in FIG. 5.

FIGS. 6–9 illustrate the heat staking attachment process used to attach the mesh 90 and 92 to the inner frame member 68 in this embodiment. FIG. 6 shows a cross-section of the frame member 68 taken through the snout region 75, with the protruding lip 124. To attach a mesh member 92 to the frame member 68, the mesh member 92 is positioned over the lip 124 (FIG. 7). A heated die member 150 is positioned over the mesh member 92, and brought downwardly against the mesh member with force. The temperature of the die member 150 is sufficient to soften or melt the plastic material defining the lip 124, so that some of the molten plastic flows into the adjacent interstices of the mesh (FIG. 8). Upon removal of the die member 150 and cooling of the plastic, the mesh member 92 is firmly attached to the member 68 all around the periphery of the window into the chamber 122. The same process is used to attach the mesh member 90 to the opposing window frame of the member 68.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink-jet pen, comprising:

an ink-jet printhead;

an ink reservoir for providing a supply of ink under negative pressure;

a fluid path between said reservoir and said printhead, said fluid path comprising a standpipe opening in fluid communication between said printhead and a fluid chamber, said chamber having first and second windows opening into said ink reservoir; and an air check valve disposed in said fluid path to prevent air from passing from said printhead into said reservoir through said fluid path while allowing adequate ink flow from said reservoir to said printhead upon demand, comprising a fine wire mesh means interposed across said fluid path for providing a mesh opening size which does not permit air bubbles to pass therethrough under a nominal air bubble pressure experienced by the pen in normal usage or storage, said mesh means comprises first and second mesh members respectively covering said first and second windows, wherein said fluid path comprises paths extending from said reservoir through said mesh members into said chamber, and through said standpipe opening to said printhead.

2. The pen of claim 1 further comprising a frame, said frame defines a snout region of said pen, said printhead is secured to an external surface of said snout region, said standpipe opening, said chamber and said mesh means being received within said snout region.

3. The pen of claim 2 wherein said frame defines a generally rectilinear ink reservoir region, and said snout region extends from one edge of said reservoir region.

4. The pen of claim 3 wherein said first and second windows are defined by peripheral frame structures to which said mesh members are secured, said frame structures including a support rib member extending between said snout region and said ink reservoir, and wherein edge regions of said membranes are secured along the periphery of said frame structures except along said rib member.

5. The pen of claim 4 further including membrane standoff elements to hold said membranes off said rib to ensure that said fluid paths remain open as said ink reservoir empties.

6. An ink-jet pen, comprising:

an ink-jet printhead;

an ink reservoir for providing a supply of ink under negative pressure;

a fluid path between said reservoir and said printhead, said fluid path comprising a standpipe having a standpipe opening in fluid communication between said printhead and a fluid chamber, said chamber having first and second windows opening into said ink reservoir, wherein said fluid path comprises paths extending from said reservoir through said mesh members into said chamber, and through said standpipe opening to said printhead; and an air check valve and filter means disposed in said fluid path for preventing air from passing from said printhead into said reservoir through said fluid path while allowing adequate ink flow from said reservoir to said printhead upon demand, thereby maintaining some negative pressure, and to prevent particulate contaminants from said ink reservoir from passing through said fluid path to said printhead, said air check valve and filter means comprising first and second mesh members respectively covering said first and second windows.

7. The pen of claim 6 further comprising a frame, said frame having a snout region, said printhead is secured to an external surface of said snout region, said standpipe opening, said chamber and said mesh means being received within said snout region.

8. The pen of claim 7 wherein said frame defines a generally rectilinear ink reservoir region, and said snout region extends from one edge of said reservoir region.

9. The pen of claim 8 wherein said first and second windows are defined by peripheral frame structures to which said mesh members are secured, said frame structures including a support rib member extending between said snout region and said ink reservoir, and wherein edge regions of said membranes are secured along the periphery of said frame structures except along said rib member.

10. The pen of claim 9 further including membrane standoff elements to hold said membranes off said rib to ensure that said fluid paths remain open as said ink reservoir empties.

* * * * *